US007545929B1

(12) United States Patent
Babb et al.

(10) Patent No.: US 7,545,929 B1
(45) Date of Patent: Jun. 9, 2009

(54) ANALOG ENCRYPTION

(75) Inventors: Harold D. Babb, Cupertino, CA (US); Michael J. Brooks, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 760 days.

(21) Appl. No.: 10/279,975

(22) Filed: Oct. 25, 2002

(51) Int. Cl.
*H04K 1/04* (2006.01)

(52) U.S. Cl. ..... 380/40; 380/38; 380/210

(58) Field of Classification Search ..... 386/33; 375/346, 295; 380/38–40, 216, 222; 379/403; 455/102, 313; 725/63, 67, 68
See application file for complete search history.

(56) References Cited

U.S. PATENT DOCUMENTS 4,654,704 A * 3/1987 Lippel ..... 380/216
6,061,555 A * 5/2000 Bultman et al. ..... 455/313
6,246,827 B1 * 6/2001 Strolle et al. ..... 386/33
6,377,314 B1 * 4/2002 Collins et al. ..... 348/723
6,580,497 B1 * 6/2003 Asaka et al. ..... 356/28.5
6,647,250 B1 * 11/2003 Bultman et al. ..... 455/102
6,973,188 B1 * 12/2005 Seitner ..... 380/38
7,088,818 B2 * 8/2006 Prendergast et al. ..... 379/403
2002/0118834 A1 * 8/2002 Wilson et al. ..... 380/222
2002/0172270 A1 * 11/2002 Whikehart et al. ..... 375/216
2003/0081705 A1 * 5/2003 Miller ..... 375/346

* cited by examiner

*Primary Examiner*—Kimyen Vu
*Assistant Examiner*—Baotran N To
(74) *Attorney, Agent, or Firm*—McDermott Will & Emery LLP

(57) ABSTRACT

The ability to securely transmit information between two locations is of paramount importance in today's communication systems. Before the invention of digital transmission methods, analog transmission was commonplace. However, today's communication systems rely almost exclusively on transmitting information digitally. Digital transmission has become commonplace because it provides optimal accuracy and security. However, digital transmission also has drawbacks, for example, increased bandwidth requirements and the loss of information when converting information between the analog and digital domains. The present invention relates to a method and apparatus for encrypting analog data while minimizing data loss and conserving bandwidth.

13 Claims, 1 Drawing Sheet

ANALOG ENCRYPTION

BACKGROUND OF THE INVENTION

1. Field of the Invention

The present invention relates method and apparatus for data encryption. More specifically, the present invention relates to a method and apparatus for encrypting analog data while minimizing data loss.

2. Background of the Invention

The ability to securely transmit information between two locations is of paramount importance in today's communication systems. Before the invention of digital transmission methods, analog transmission was commonplace. However, today's communication systems rely almost exclusively on transmitting information digitally. Digital transmission has become commonplace because it provides optimal accuracy and security. While it is optimal for many applications, digital transmission also creates a major disadvantage. In order to convert an analog signal into the digital domain, analog information must be sampled in accordance with, for example, the Nyquist sampling theorem. According to this theorem, an analog signal should be sampled at least twice the frequency of the analog signal. Therefore, transmitting information digitally requires the necessary bandwidth to be a function of the sampling frequency, the number of bits per sample, and the bandwidth efficiency of the modulator. For many systems, digital transmission can drastically increase the bandwidth that is required. In certain applications where bandwidth is limited, analog transmission can be more efficient. However, because of the increased accuracy and encryption ability afforded by digital transmission, current secure communication systems have not focused on securely transmitting data in the analog domain.

Another drawback of digital systems is their reliance on data compression. A typical example of this can be described with respect to a DVD player. The data on a DVD is in a highly compressed digital format. When a DVD disk is read by a DVD player, the player processes the compressed digital information and expands it into a visual image. However, during the process of expanding the information to form an image, some information is lost. In the case of a DVD player, the loss of information cannot be detected by the human eye. However, in applications where it is desirable to recover transmitted information completely, this would be disadvantageous.

A continuing need exists for improved methods and apparatus that can transmit analog data securely while minimizing the distortion of information.

SUMMARY OF THE INVENTION

An object of the present invention is to transmit data securely.

Another object of the present invention is to transmit data securely in the analog domain.

Yet another object of the present invention is to transmit data securely without compressing the data.

Still another object of the present invention is to encrypt transmitted data using a non-linear code.

Still another object of the present invention is to conserve bandwidth.

Yet another object of the present invention is to transmit data securely using a distortion free linear process.

Still another object of the present invention is to frequency shift an input signal.

Still another object of the present invention is to phase shift an input signal.

Still another object of the present invention is to transmit data securely without adding observable delay or amplitude distortion.

Still another object of the present invention is to recover securely transmitted data using the complex conjugate of the encryption modulation.

The present invention achieves the above and other objects by providing a method for encoding an analog signal, the method comprising: receiving an analog signal; isolating a predetermined part of the analog signal; generating a modulating signal; and combining the received analog signal with the modulating signal.

Figure 1:
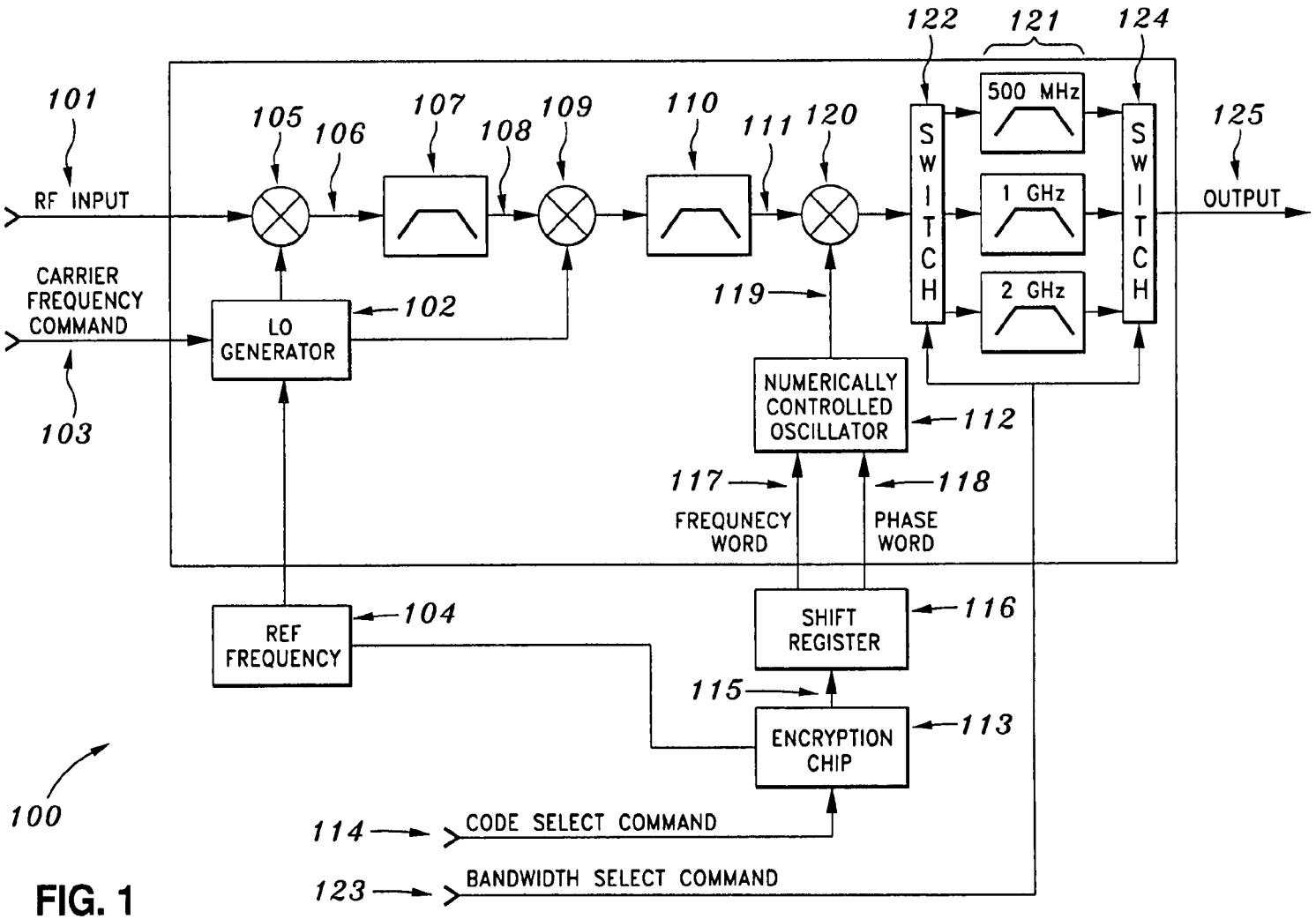
FIG. 1 is a diagram showing an exemplary embodiment of the present invention.

Other and further objects of the present invention will be apparent from the following description and claims and are illustrated in the accompanying drawing, which by way of illustration, show preferred embodiments of the present invention. Other embodiments of the invention embodying the same or equivalent principles may be used and structural changes may be made as desired by those skilled in art without departing from the present invention and the purview of the appended claims.

DETAILED DESCRIPTION OF THE DRAWINGS

FIG. 1 is a block diagram showing an exemplary embodiment of a transmitter embodying the present invention. The transmitter can be ground, air, or space based, depending on the particular application. In the exemplary embodiment, an input signal 101 is received by the exemplary transmitter 100. The input signal 101 can operate in any frequency range, and can be determined according to the objectives of a given application. In the exemplary embodiment, the input signal 101 operates in the radio frequency (RF) spectrum.

In the exemplary embodiment, a local oscillator generator 102 generates a signal that has a predetermined frequency. The frequency of the local oscillator 102 signal is determined by two input signals. The first input signal is a carrier frequency command 103. This frequency can be chosen according to a particular application. The second input signal is generated by a reference frequency generator 104. An example of one type of frequency generator is a rubidium frequency generator. Rubidium frequency generators are typically used because of their precision, and are well known to those skilled in the art. Typically, a frequency generator is chosen according to its degree of stability and precision. In particular, precision generators with low phase noise are desirable. In the exemplary embodiment of the present invention, a high precision frequency generator is required in order to be able to fully retrieve the encoded signal.

When the input signal 101 and the output of the local oscillator 102 are combined, a combined signal 106 is produced. The combined signal 106 is in a very high frequency range, for example, 35-40 GHz. However, this can be changed according to a particular application. The combined signal 106 includes, for example, the sum product of the two signals, the difference product of the two signals, and the residual local oscillator carrier. However, other signals can be produced in different applications. The desired signal is the sum product of the two signals. In order to remove the unwanted harmonics, the combined signal 106 can be filtered. A properly designed filter will allow the mixed product signal to be isolated while removing the other harmonics.

In the exemplary embodiment, the filter comprises a bandpass filter 107. The bandwidth that is allowed through the filter depends on the particular application, and can vary depending on the number and frequency of the signals that are combined. Bandpass filters are often difficult to realize at low frequency ranges. By causing the combined signal 106 to have a high frequency, a realizable bandpass filter can be designed. Another advantage of the high frequency of the combined signal 106 is that the original input signal 101 represents only a small percentage of the combined signal 106. This allows the bandpass filter 107 a greater degree of tolerance, and ensures the complete input signal 101 will pass through the filter 107.

The filtered signal 108 is a high frequency signal. As discussed previously, the high frequency signal is necessary to properly filter the input signal 101. However, after the combined signal 106 has been filtered, such a high frequency signal is no longer desirable. In the exemplary embodiment, after the combined signal 106 is filtered, the filtered signal 108 is once again combined with the output signal from the local oscillator 102. This takes place at mixer 109, and results in a signal spectrum that has, for example, three components. In the exemplary embodiment, these components comprise, for example, a local oscillator signal plus the filtered signal 108 (upper sideband), the local oscillator signal minus the filtered signal 108 (lower sideband), and a reduced amplitude local oscillator signal. At least one of the three exemplary components are chosen based on the desired transmission frequency. In other embodiments, the filtered signal 108 can be left at a high frequency, or it can be translated to another frequency to achieve the objectives of a given application.

In order to reduce the frequency of the signal from the mixer 109, the signal is once again filtered in order to isolate one of the three exemplary components. In the exemplary embodiment, this filter comprises a bandpass filter 110. In the exemplary embodiment, the bandpass filter 110 allows the lower sideband signal to be selected. This allows a lower frequency signal to pass through the filter 110. The second filtered signal 111 can subsequently be encoded. Other filters or methods or removing unwanted harmonics can be used, and can be determined by those skilled in the art.

In the exemplary embodiment of the present invention, signal 111 is combined with the output of a numerically controlled oscillator (NCO) 112 in order to produce an encrypted signal for transmission. In the exemplary embodiment, the output of the NCO 112 is generated through several steps. However, the present invention is not intended to be limited to any steps, hardware, or sequence thereof. In the exemplary embodiment of the present invention, an encryption chip 113 receives a code 114 and the output of the reference frequency generator 104 as inputs. The code 114 can be, for example, any binary numeric sequence, and can be chosen according to a particular application.

In the exemplary embodiment, the encryption chip 113 processes the code 114 and the reference frequency 104. The exemplary encryption chip 113 operates by generating a code sequence 114 based on a key and a clock signal. However, any type of encryption method can be used, depending on the particular application. In the exemplary embodiment, the code 114 is non-linear. A non-linear code is a code that cannot be factored. Having a signal 115 with a non-linear code 114 decreases the chances of an intruder being able to decipher the code 114. This allows the data to be transmitted securely.

After the encryption chip 113 generates the signal 115 with a non-linear code 114, it can be sent to a storage mechanism. The storage mechanism can store the signal 115 until it is needed to encrypt signal 111. In the exemplary embodiment, the storage mechanism comprises a shift register 116. Data can be stored in the shift register 116 for a variety of reasons. For example, in the exemplary embodiment, data is stored in a shift register 116 in order to provide the option for additional security. The shift register 116 shown in the exemplary embodiment has two outputs: a frequency output 117; and a phase output 118. The frequency output 117 provides the encryption code 114 that is used to modulate the frequency of signal 111. The phase output 118 provides the encryption code 114 that is used to modulate the phase of signal 111. By storing the non-linear code 114 in the shift register 116, a time delay can be added to the code.

For example, in the exemplary embodiment, the encryption chip 113 generates a non-linear code signal 115. This signal 115 is then sent to the shift register 116. The shift register 116 can hold the code signal 115 for any amount of time, depending on the specific application. If the shift register 116 sends the code signal 115 to the frequency output 117 at time t=0, and to the phase output 118 at time t=1, the frequency and the phase of signal 111 would be encrypted with different codes. In this way, an intruder who deciphers the code for, say, the frequency modulation of the signal 111, would still have to decipher the code for the phase modulation of the signal 111 in order to fully decode the signal. Having two different codes greatly decreases the chances of an intruder being able to decode a transmitted signal. In some applications, however, eliminating the storage device may be advantageous. For example, in applications where power consumption, space, or cost must be minimized, the disadvantages of the storage device may outweigh the advantages. In applications where the storage device is not included, the frequency and the phase of signal 111 would be modulated based on a substantially similar code. The storage device does not have to be a separate device. For example, it may be part of the encryption chip 113, or the numerically controlled oscillator 112, depending on a particular application.

In the exemplary embodiment, the NCO 112 receives the frequency signal 117 and the phase signal 118 from the shift register 116. As discussed before, these codes can be substantially similar, or can have a time delay with respect to one another. The NCO 112 generates an encryption signal 119. In the exemplary embodiment, the encryption signal 119 is in the radio frequency spectrum. However, this can be changed according to a particular application. The encryption signal 119 varies in frequency and phase. The variation in frequency and phase is determined according to the clocking rate and non linear code inputs, which are responsible for programming in the NCO 112. Numerically controlled oscillators are well known to those skilled in the art. Any NCO 112 can be used, based on the objectives of a particular application.

The encryption signal 119 and signal 111 are combined at mixer 120. The output of the mixer 120 is an encoded signal that is at the desired transmission frequency. The exemplary embodiment supports the capability of determining the bandwidth of the signal to be transmitted. This can be helpful in communication applications where the available bandwidth is limited. In order to limit the bandwidth of the signal, the encoded signal can be processed by a filtering mechanism. One example of a filtering mechanism is a bandpass filter. In the exemplary embodiment, three different bandpass filters 121 are employed. The bandwidth of these filters can be, for example, 2 GHz, 1 GHz, and 500 MHz. These are just examples, and can be changed according to a particular application.

The center frequency of the bandpass filters 120 can be chosen according to the desired transmission frequency. In the exemplary embodiment, the desired center frequencies are between, for example, 18.0-21.2 GHz. In the exemplary embodiment, the encoded signal is sent to a bandpass filter via a switch 122. The switch 122 determines which filter to send the signal to based on an input bandwidth select command 123. The bandwidth select command 123 also controls a second switch 124. The second switch 124 sends the filtered signal to an output port 125. This encoded signal is ready for transmission. In the exemplary embodiment, the signal at the output port 125 is transmitted in the Ka frequency band, for example, between from 18-30 GHz. However, the signal at the output port 125 can be transmitted in other frequency bands, which can be determined according to a particular application.

Although the invention has been described with reference to particular embodiments, it will be understood to those skilled in the art that the invention is capable of a variety of alternative embodiments within the spirit of the appended claims.

The invention claimed is:

1. A method for encoding an analog signal for secure transmission, said method comprising:

receiving the analog signal having a frequency and a phase;

combining the analog signal with a modulating signal to form a first combined signal;

isolating an upper sideband of the first combined signal;

combining the upper sideband of the first combined signal with the modulating signal to form a second combined signal;

isolating a lower sideband of the second combined signal;

generating an encryption signal varying in frequency and phase, the encryption signal being generated independent of the analog signal; and modulating the frequency and phase of the lower sideband of the second combined signal with the encryption signal, thereby generating an encoded analog signal for secure transmission.

2. The method according to claim 1, further comprising selecting a bandwidth for said encoded analog signal.

3. The method according to claim 2, wherein said selecting comprises band pass filtering.

4. The method according to claim 1, wherein said generating comprises:

receiving a first code;

generating a non-linear code based on said received code; and generating said encryption signal based on said non-linear code.

5. The method according to claim 4, wherein said generating said encryption signal further comprises delaying said non-linear code.

6. The method according to claim 1, wherein said encryption signal is generated based on a numerically controlled oscillator.

7. The method according to claim 1, wherein said isolating comprises band pass filtering.

8. A transmitter for encoding an analog signal for secure transmission, said transmitter comprising:

means for combining the analog signal having a frequency and a phase with a modulating signal to form a first combined signal;

means for isolating an upper sideband of the first combined signal;

means for combining the upper sideband of the first combined signal with the modulating signal to form a second combined signal;

means for isolating a lower sideband of the second combined signal;

means for generating an encryption signal independently of the analog signal, the encryption signal varying in frequency and phase; and means for modulating the frequency and phase of the lower sideband of the second combined signal with the encryption signal thereby generating an encoded analog signal for secure transmission.

9. The transmitter according to claim 8, further comprising means for selecting a bandwidth for said encoded analog signal.

10. The transmitter according to claim 8, wherein said generating means comprises:

means for generating a non-linear code based on a first code; and means for generating said encryption signal based on said non-linear code.

11. A transmitter for encoding an analog signal for secure transmission, said transmitter comprising:

a first mixer for combining the analog signal having a frequency and a phase with a modulating signal to form a first combined signal;

a first isolation circuit for isolating an upper sideband of the first combined signal;

a second mixer for combining the upper sideband of the first combined signal with the modulating signal to form a second combined signal;

a second isolation circuit for isolating a lower sideband of the second combined signal;

an encryption circuit for generating an encryption signal independently of the analog signal, the encryption signal varying in frequency and phase; and a third mixer for modulating the frequency and phase of the lower sideband of the second combined signal with the encryption signal thereby generating an encoded analog signal for secure transmission.

12. The transmitter according to claim 11, further comprising:

an output port;

a plurality of filters;

a first switch for sending said encoded analog signal to one of said plurality of filters; and a second switch for sending said filtered encoded analog signal to said output port.

13. The transmitter according to claim 11, wherein said encryption circuit comprises:

a chip for generating a non-linear code based on a received code; and a numerically controlled oscillator for generating said encryption signal based on said non-linear code.

* * * * *